US005592884A

United States Patent [19]

Glick et al.

[11] Patent Number: 5,592,884

[45] Date of Patent: Jan. 14, 1997

[54] MOLDED TABLE WITH STORAGE COMPARTMENT

[75] Inventors: Irving Glick, Englewood Cliffs, N.J.; Peter Miale, Brooklyn, N.Y.

[73] Assignee: Imp Designs, Inc., Brooklyn, N.Y.

[21] Appl. No.: 502,496

[22] Filed: Jul. 14, 1995

[51] Int. Cl.[6] ..... A47B 85/00

[52] U.S. Cl. ..... 108/25; 108/91

[58] Field of Search ..... 100/25, 91, 26, 100/24

[56] References Cited

U.S. PATENT DOCUMENTS

| | | | |
|---|---|---|---|
| D. 335,053 | 4/1993 | Morin . | |
| D. 346,704 | 5/1994 | Grosfillex . | |
| D. 347,527 | 6/1994 | Breen et al. . | |
| 1,130,550 | 3/1915 | Stephens et al. . | |
| 1,201,903 | 10/1916 | Wiley . | |
| 1,361,299 | 12/1920 | Baseman . | |
| 1,408,114 | 2/1922 | Mathieu | 108/91 X |
| 2,683,639 | 7/1954 | Brenny | 108/26 X |
| 3,289,616 | 12/1966 | Donihi | 108/25 X |
| 3,290,108 | 12/1966 | Beckman et al. . | |
| 3,364,882 | 1/1968 | Merrick . | |
| 4,437,714 | 3/1984 | Struck . | |
| 4,747,352 | 5/1988 | Guidry et al. | 108/26 X |
| 4,876,969 | 10/1989 | Infanti . | |
| 5,055,081 | 10/1991 | Nayak | 108/26 X |
| 5,060,580 | 10/1991 | Shaw . | |
| 5,327,838 | 7/1994 | Beltman . | |
| 5,421,270 | 6/1995 | Kelly | 108/25 |

FOREIGN PATENT DOCUMENTS

| | | | |
|---|---|---|---|
| 2108826 | 5/1972 | France | 108/91 |
| 1172815 | 6/1964 | Germany | 108/25 |
| 83945 | 8/1956 | Netherlands | 108/91 |
| 871903 | 7/1961 | United Kingdom | 108/91 |
| 2140290 | 11/1984 | United Kingdom | 108/25 |
| 2229625 | 10/1990 | United Kingdom | 108/91 |

*Primary Examiner*—Jose V. Chen

*Attorney, Agent, or Firm*—Lerner, David, Littenberg, Krumholz & Mentlik

[57] ABSTRACT

A table has a storage area for ice, comestibles and cold beverages composed of a table top having an upper surface, a lower surface and an opening medially spaced in said upper surface extends through the table top. A number of spaced legs are connected to the table top on opposite sides of the medially disposed opening for supporting the table top at a predetermined height above a supporting surface. A container defining a storage compartment is affixed to the table top about the opening, and a removable lid is disposed in the opening to maintain the storage compartment normally closed. The container has a length equal to that of the legs and works together with the legs in supporting the table top. The table top, legs and container are so assembled that a plurality of the tables can be stacked one upon the other in the shipping, storing and moving of the tables. Spacer fins are connected to the container to prevent the table from sticking when a plurality of the tables are disassembled. The table top has a lower surface with a bracket for holding the removable lid when the tables are shipped, stored or moved.

23 Claims, 4 Drawing Sheets

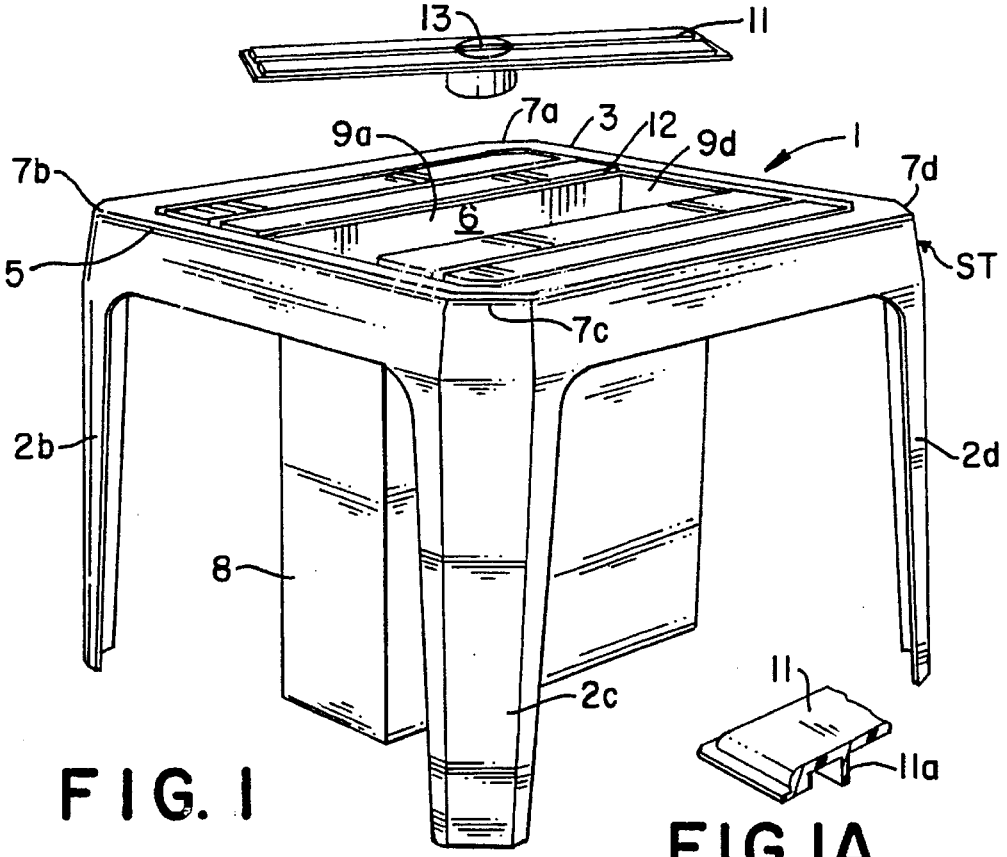
FIG. 1
FIG. 1A
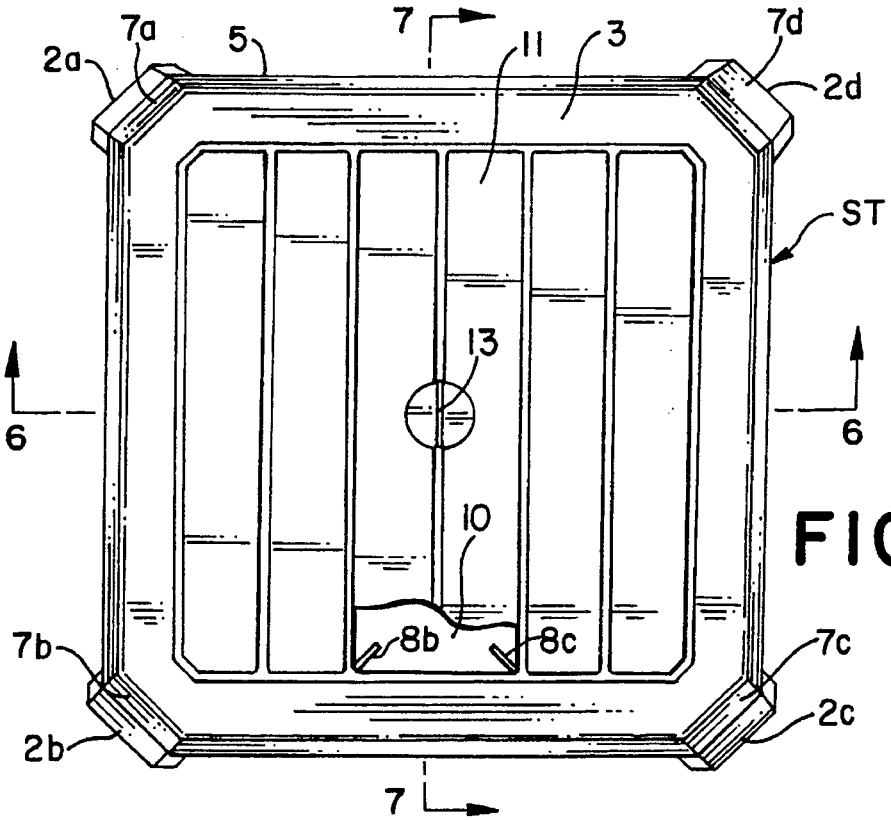
FIG. 2

MOLDED TABLE WITH STORAGE COMPARTMENT

BACKGROUND OF THE INVENTION

The invention relates generally to furniture made from plastic materials, and more particularly to a side table molded from synthetic plastic with a table top having a medially disposed opening and an integrally connected container defining a storage compartment accessible through the opening in the table top, which container coacts with the supporting legs for the table to aid in supporting the table, the legs and coacting container disposed to permit a plurality of the tables to be stacked for shipping or storing purposes.

Tables in various shapes and sizes have long been used for storing articles in proximity to the top surface of the table. Various types of table structures with self-contained storage areas are numerous. Examples are play tables with self-contained storage units, portable bars with cabinets, conference tables with concealed storage areas, and food management tables are just some examples of furniture having a storage area located below the top surface.

Attention is also called to U.S. Pat. No. 5,327,838 granted Jul. 12, 1994 to Charles H. Beltman; U.S. Pat. No. 4,437,714 granted Mar. 20, 1984 to Gordon K. Struck; U.S. Pat. No. 3,364,882 granted Jan. 23, 1968 to Bruce P. Merrick; U.S. Pat. No. 3,290,108 granted Dec. 6, 1966 to Ronald H. Beckman; and U.S. Pat. No. 1,130,550 granted Mar. 2, 1915 to Cyris Stephens.

For example, U.S. Pat. No. 3,290,108 discloses a conference table that has a substantial storage base that does not project above the flat conference surface. U.S. Pat. No. 5,327,838 relates to a table with integral storage areas accessible through the work surface. This patent provides a table capable of storing articles underneath the entire area of the table top without decreasing the surface area of the table top. Furthermore, U.S. Pat. No. 3,364,882 discloses the use of a leaf-type table with a beverage cooler which can be placed thereon in lieu of a leaf whereby beverages may be maintained in a chilled condition within reach of those using the table.

A drawback of the majority of the above mentioned solutions is that none provides a container which lends added support to the table structure while simultaneously providing a compartment space for storing articles such as ice, food, cold beverages and the like. The present invention addresses the support problems in the prior art by providing a container that has a length generally equal to the length of the leg members. Further, the synthetic resin materials provide adequate insulation so that the storage compartment can be used to keep ice cold or to store comestibles and beverages which can be cooled or maintained cold in the storage compartment.

The invention is particularly advantageous when the tables are made or molded from synthetic plastic because the manufacture is simplified and the light weight of such plastic materials is desirable because it allows for ease in moving the table structure during outdoor activities such as barbecues or other social or the like type of functions and entertainment.

Another benefit of the improved molded side table is that the design has the capability of permitting at least two or more tables to be stacked, thereby reducing the space necessary for shipping and storage purposes.

SUMMARY AND OBJECTS OF THE INVENTION

Thus, the present invention covers an improved table having, a table top with a medially disposed opening preferably and normally maintained closed by a removable cover or lid and a number of spaced legs connected to the table top for supporting the table top at a predetermined height. A container defining a storage compartment is affixed to the underside of the table top about the opening so that the storage compartment is accessible through the opening in the table top. The container has a length generally equal to the length of the spaced legs to enable the container to coact with the legs in supporting the table top and includes means disposed in the storage compartment to permit at least two or more tables to be stacked for advantageous reduction in space for shipping and/or for storage of the tables and to facilitate moving the tables during use.

Accordingly, it is an object of the present invention to provide an improved table that will serve effectively both as a contemporary table and/or a table with a readily accessible storage area.

It is another object of the present invention to provide a relatively light, portable table molded from a synthetic plastic having a container located beneath the table top for the table defining a storage area for ice, comestibles, beverages and the like so sized and shaped that the container coacts with the support legs for the table to provide additional support for the table.

It is still another object of the present invention to provide a table with means defining a storage area which can be stacked for advantageous reduction in space for shipping, for storage and for moving of the tables.

These and other objects will become readily apparent from the description and claims which follow when taken in conjunction with the drawings.

BRIEF DESCRIPTION OF THE DRAWINGS

FIG. 1 is an exploded perspective view of one embodiment of the molded plastic table in accordance with the present invention showing the removable cover or lid spaced from its normally closed position to show the medially disposed opening in the top or working surface of the molded plastic table, FIG. 1A is a fragmentary view of a portion of the removable cover or lid shown in FIG. 1 partly in vertical section, FIG. 2 is a top plan view of the molded plastic table shown in FIG. 1 with the removable cover or lid in the normally closed position in the medially disposed opening in the top or working surface of the molded plastic table and broken away in plan view to show the spacer fins formed in the container for preventing the tables from sticking together when it is desired to unstack the tables one from the other.

DESCRIPTION OF A PREFERRED EMBODIMENT

Figure 3:
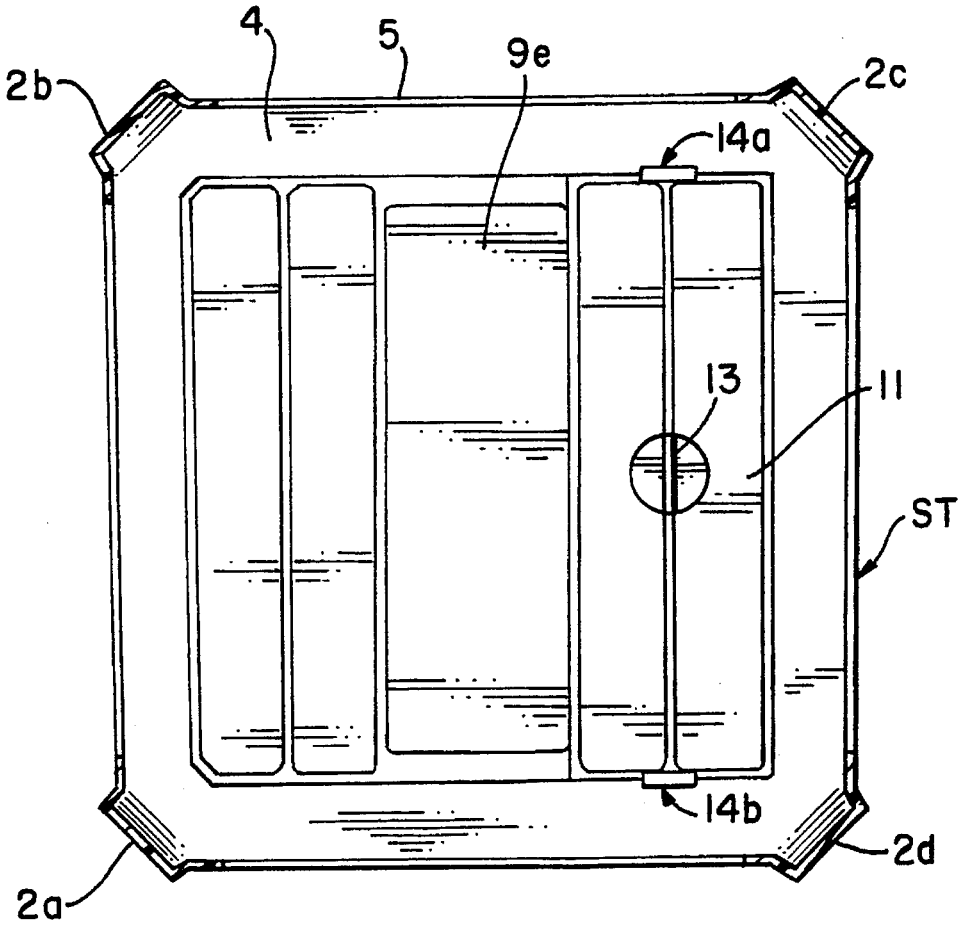
FIG. 3 is a bottom plan view of the molded plastic table shown in FIGS. 1 and 2 partly in horizontal section because the legs are removed and showing the removable cover or lid detachably connected to the underside of the table top when the tables are stacked for shipping, storing or other purposes.

Referring in detail to the drawings, the FIGURES depict one embodiment of a side table ST in accordance with the present invention.

Table ST may be fabricated but preferably is manufactured by molding as an integral unit from plastics such as synthetic resins, polyethylene, polypropylene, ABS, etc., as will be understood by those skilled in the art. Such molding processes from synthetic plastic materials is well known in the art and hence is not more fully described herein.

Table ST includes, a table top 1 and spaced leg members 2*a*, 2*b*, 2*c* and 2*d* which support the table at a predetermined height above any given support surface on which the table ST is placed. Table top 1 has an upper surface 3, a lower surface 4 and a peripheral edge 5. The upper surface 4 of the table top 1 is generally geometric in plan view and has an opening as at 6 formed therein and medially spaced with respect to the legs 2*a*, 2*b*, 2*c* and 2*d*. The opening 6 is medially spaced to enable tables in accordance with the present invention to be stacked on top of the other as will be clear with respect to the description which follows below.

The shape of the table top 1 can be octagonal, triangular, square, rhombus, or trapezoidal. The illustrated table top 1 is generally octagonal in plan view, and the peripheral edge 5 therefore includes at least four side edges as at 7*a*, 7*b*, 7*c* and 7*d*.

The four spaced and sized leg members 2*a*, 2*b*, 2*c* and 2*d* are connected at their upper ends to the peripheral edge 5 at the respective side edges 7*a*, 7*b*, 7*c* and 7*d* and have a length for supporting the table top 1 at a predetermined height. The leg members 2*a*, 2*b*, 2*c* and 2*d* are preferably molded integrally with the table top 1.

Operatively associated with the table top 1 and the spaced legs 2*a*, 2*b*, 2*c* and 2*d* is a container 8 having sides 9*a* and 9*b*, ends 9*c* and 9*d* and a bottom 9*e* which define and form a storage compartment or chamber 10 that is open at one end. The container 8 is also preferably and integrally formed with the table top 1 so that it is connected to the lower surface 4 of the table top 1 about the opening 6. This permits opening 6 to communicate with and provide access to the storage compartment 10, when the table is in use, by removing the removable cover or lid 11, which normally maintains the opening 6 closed.

The length of the container 8 is generally equal to the length of the leg members 2*a*, 2*b*, 2*c* and 2*d* and is sized and shaped to coact with the leg members 2*a*, 2*b*, 2*c* and 2*d* so as to provide supplemental support for holding the table top 1 at the predetermined height, all of which is shown at FIGS. 1, 2, 6 and 7 of the drawings.

Further, however, by reason of the fact that the sides 9*a*, 9*b* and the ends 9*c* and 9*d* are slightly tapered from their point of connection with the opening 6 in the table top 1, by the proper sizing and shaping of the legs relative the table top 1 and the operatively associated container 8, at least two or more tables can be nested together to reduce the space occupied by such tables if not nested and facilitate shipping, storage or the moving of several of such tables from place to place.

FIGS. 2, 4, 5, 6, 6A and 7 show that spacer fins as at 8*a*, 8*b*, 8*c*, and 8*d* are formed and molded at the intersection of the side walls 9*a* and 9*b* with the end walls 9*c* and 9*d* so they extend upwardly from the bottom 9*e* about a third of the depth of the storage compartment 10 formed in the container 8 and outwardly at an angle to the respective side walls 9*a* and 9*b* and end walls 9*c* and 9*d* a short distance so as not to occupy substantial space in the storage compartment.

At their uppermost ends as at 8*e*, 8*f*, 8*g* and 8*h*, the spacer fins are generally flat. Thus, when at least two or more tables are nested or stacked so that the container 6 of each respective table ST rests within the storage compartment 10 of the next table ST, the container can only extend into the next adjacent storage compartment until it comes into contact with the uppermost ends of the associated spacer fins 8*a*, 8*b*, 8*c* and 8*d* formed in the next adjacent storage compartment. Thus, the spacer fins 8*a*, 8*b*, 9*c* and 9*d* prevent the containers from being fixedly seated in the adjacent storage compartment of another table when two or more tables are stacked or nested together for any purpose. Further, this facilitates the unstacking of the tables when it is necessary or desirable to separate the tables for any purpose.

Referring now to FIGS. 1, 1A, 6 and 7, table top 1 is recessed in the upper surface 3 about the opening 6 to form a sealing shoulder 12. FIG. 1A shows that the removable cover or lid 11 has an inwardly extending annular flange 11*a* so that in assembled position when the removable cover or lid 11 engages the sealing shoulder 12 the annular flange 11 is positioned in the opening 6 in the table top 1 and is normally disposed in assembled position to maintain the opening 6 normally closed and generally sealed. Those skilled in the art will recognize that a suitable sealing material can be added to the annular flange 11*a*, not shown, to improve the seal so as to prevent ice in the storage compartment 10 from melting and to prevent heat from infiltrating the storage compartment, without departing from the scope of the present invention.

The storage compartment 10 in the container 8 can be accessed by removing the cover or lid 11 by means of a cross-member or handle 13 for grasping the lid 11, all of which is shown in FIGS. 1, 1A, 2, 3, 6 and 7 of the drawings.

Figure 3A:
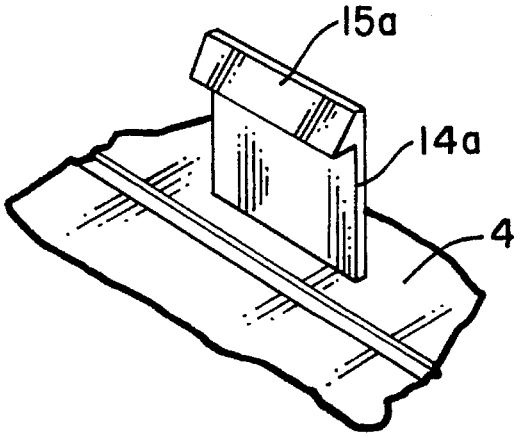
FIG. 3A depicts an exploded enlarged fragmentary bottom view showing one of the spaced latches for detachably connecting the cover or lid.
Figure 4:
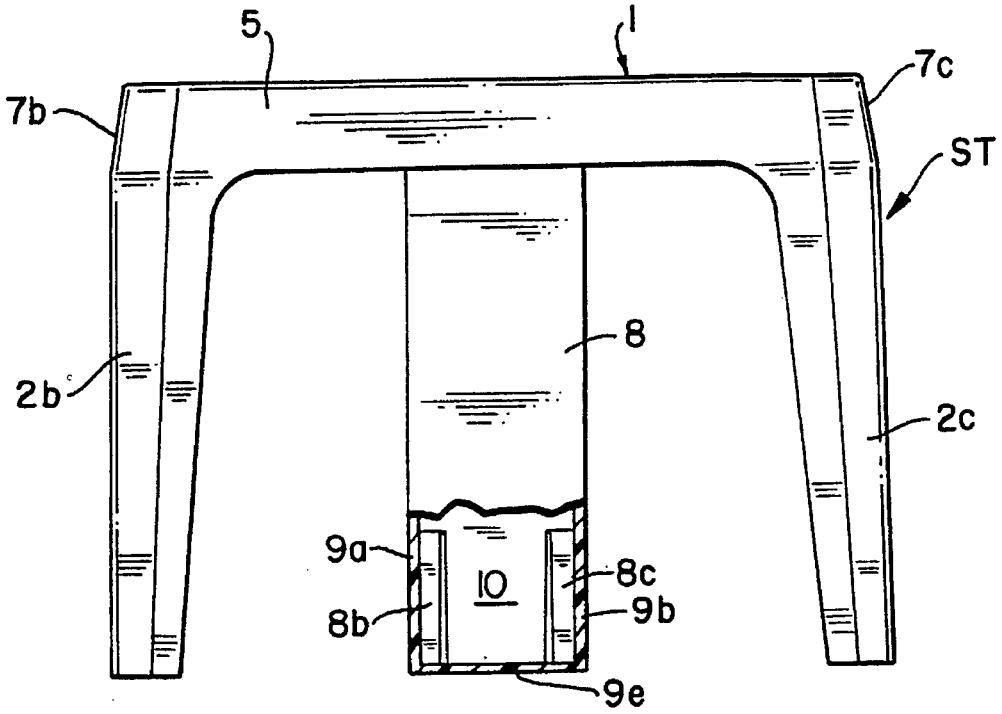
FIG. 4 is front view of the molded plastic table shown in FIGS. 1 and 2 with the container broken away in vertical section to show the storage chamber and the spacer fins to aid in the stacking and unstacking of two or more of the tables, FIG. 5 a left side view of the molded plastic table Shown in FIGS. 1 and 2 with the container broken away in vertical section to show the storage chamber and the spacer fins to aid in the stacking and unstacking of at least two or more tables.
Figure 5:
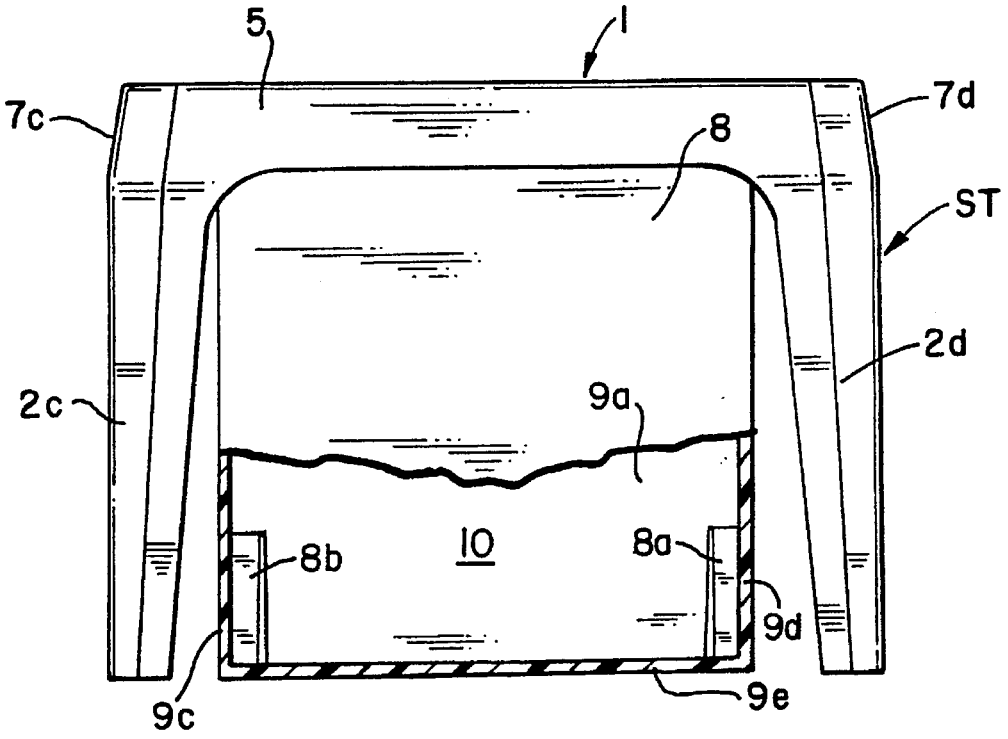
Figure 6:
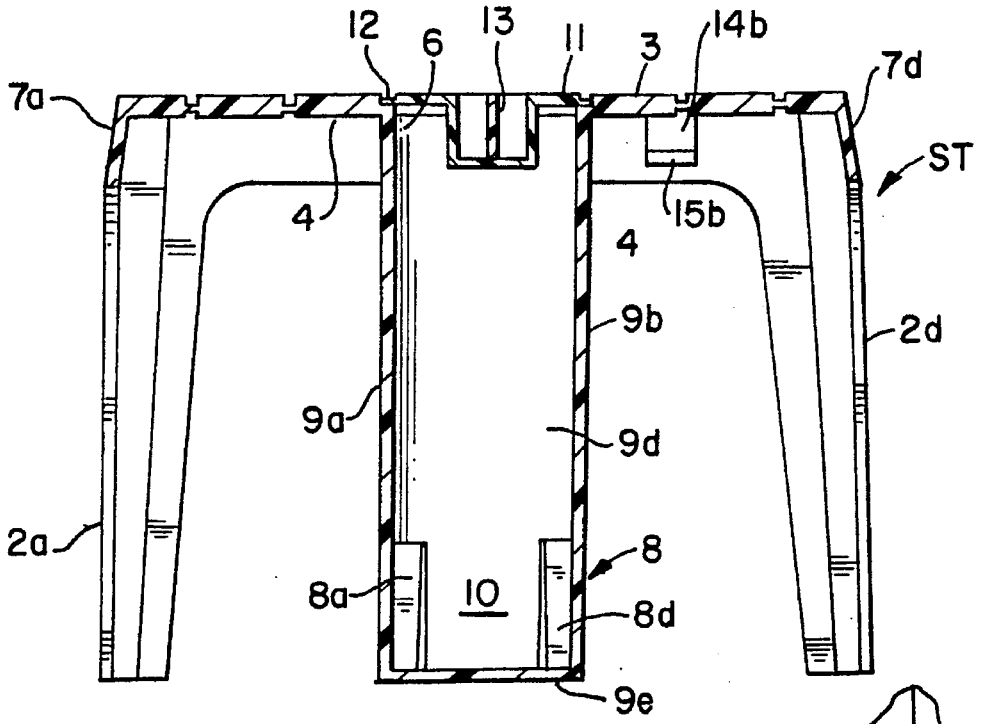
FIG. 6 is a vertical cross-section taken on line 6—6 of FIG. 2 showing the storage chamber and the spacer fins formed in the container.
Figure 6A:
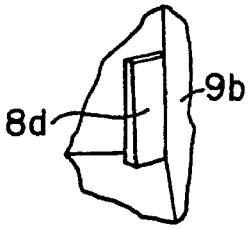
FIG. 6*a* is a fragmentary view of a portion of FIG. 6.
Figure 7:
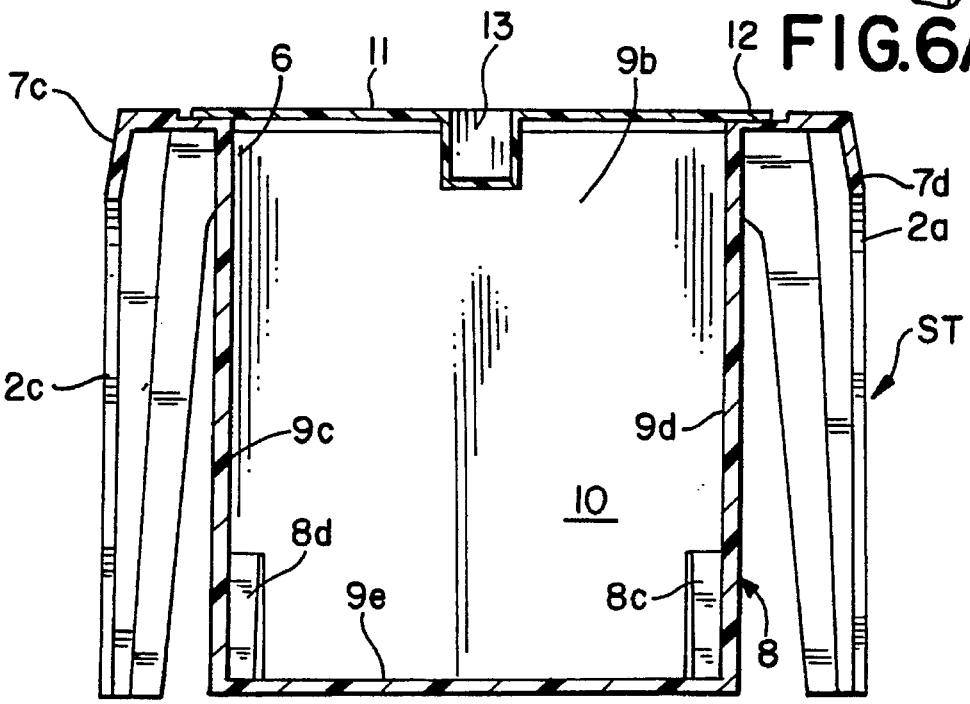
FIG. 7 is a vertical cross-section taken on line 7—7 of FIG. 2 showing the storage compartment and spacer fins formed in the container.

Referring further to FIG. 3, which depicts a bottom view of the molded side table ST, spaced brackets 14*a* and 14*b* are formed on the lower surface 4 of the table top 1. Spaced brackets 14*a* and 14*b* enable the removable cover 11 to be fitted, shipped or stored with the molded side table when not in assembled position. Brackets 14*a* and 14*b* are identical to each other, and FIGS. 3A and 6 illustrates brackets 14*a* and 14*b* as projecting normal to the lower surface 4. Each of the brackets 14*a* and 14*b* have a tongue-like snap-in unit as at 15*a* and 15*b* which are sized to receive and removably hold the opposite ends of the removable cover 11 in this stored position until it is needed to normally close and seal the medially spaced opening 6 for a given table ST when the table ST is placed into use, all as above describe.

Those skilled in the art will recognize that numerous variations and combinations of the features described above can be utilized without departing from the scope of the present invention. Thus the foregoing description of the preferred embodiment should be taken by way of illustration rather than by way of limitation of the invention as defined by the appended claims.

We claim:

1. A table comprising:

table top means with, an upper surface, a lower surface, and an opening therethrough disposed medially in the upper surface;

spaced leg means connected to said table top means on opposite sides of said medially disposed opening having a length for supporting said table top means at a predetermined height; and container means affixed to the lower surface of said table top means about said opening having a length generally equal to the length of said spaced leg means for coacting with said leg means in supporting said table top means.

2. In the table as in claim 1, wherein said container means includes, means defining a storage compartment disposed for communication with the opening in said table top means.

3. In the table as in claim 1 or 2 wherein said container means and said leg means are sized and shaped and coact to permit more than one table to be stacked and nested one on top of the other.

4. In the table as in claim 1 or 2 including, spacer means in the storage compartment of the container means to prevent the table from sticking when more than one table are stacked and nested together.

5. In the table as in claim 1 or 2 including, a removable cover means positioned in the opening in the upper surface of said table top means to normally maintain said opening closed.

6. In the table as in claim 5 wherein said cover means includes, means to enable said cover means to be removed from assembled position in said table top means to access the storage compartment in said container means.

7. In the table as in claim 1 wherein, said table top means has a generally geometric shape in plan view, and a peripheral edge, said peripheral edge having at least one side section, said leg means including, a plurality of shaped and sized leg members integral with said table top means, and at least one of said plurality of leg members connected to at least one of said side sections on the table top means.

8. In the table as in claim 1, wherein said table top means, said leg means and said container are molded integrally from a synthetic plastic.

9. A molded table made from synthetic plastic comprising:

table top means having, an upper surface substantially geometric in plan view, a lower surface and a peripheral edge;

said table top means having, means defining an opening therethrough medially disposed in the upper surface of the table top;

plurality of paced leg means connected to the peripheral edge of the table top means on opposite sides of said means defining the opening in the table top means;

container means affixed to the lower surface of said table top means about said opening having a length generally equal to the length of said spaced leg means for coacting with said leg means in supporting said table top means; and said container means having, means defining a storage compartment disposed for communication with the opening in said table top means.

10. In the table as in claim 9 wherein said container means and said leg means are sized and shaped and coact to permit more than one table to be stacked and nested one on top of the other.

11. In the table as in claim 9 or 10 including, spacer means in the means defining the storage compartment of the container means to prevent the table from sticking during disassembly when more than one table are stacked and nested together.

12. In the table as in claim 9 or 10 including, a removable cover means positioned in the opening in the upper surface of said table top means to normally maintain said opening closed.

13. In the table as in claim 12 wherein said cover means includes, means to enable said cover means to be removed from assembled position in said table top means to access the storage compartment in said container means.

14. A molded table made from synthetic plastic comprising:

table top means having, an upper surface, a lower surface, a peripheral edge, and means defining an opening therethrough medially disposed in said upper surface;

leg means formed integrally with said table top means, said leg means having, a plurality of spaced and sized leg members connected at their upper ends to the peripheral edge of the table top means for holding the table top at a predetermined height;

container means including, means forming a storage compartment open at one end;

said container means connected to the lower surface of the table top means about the means defining the opening to enable the storage compartment to communicate with said opening; and said container means sized and shaped to coact with said leg means to provide supplemental support for holding said table top at the predetermined height.

15. In the table as in claim 14 wherein said container means and said leg means are sized and shaped and coact to permit more than one table to be stacked and nested one on top of the other.

16. In the table as in claim 14 or 15 including, spacer means on the container means to prevent the table from sticking on disassembly when more than one table are stacked and nested together.

17. In the table as in claim 14 or 15 including, a removable cover means positioned in the opening in the upper surface of said table top means to normally maintain said opening closed.

18. In the table as in claim 17 wherein said removable cover means includes, means to enable said removable cover means to be removed from assembled position in said table top means to access the storage compartment in said container means.

19. In the molded table as in claim 14 or 15 wherein:

the means defining the opening in the table top means is recessed at the upper surface of the table top to form a sealing shoulder, and removable cover means sized and shaped for mating engagement with the sealing shoulder and the opening in the table top means to maintain the opening normally closed.

20. In the molded table as in claim 19 wherein the removable cover means includes, a peripheral edge, and an annular flange means connected inwardly of the peripheral edge of the removable cover means.

21. In the molded table as in claim 19 including, bracket means on the lower surface of the table top means, and said removable cover means disposed to fit into said bracket means when not in assembled position for maintaining the opening in the upper surface of the table top normally closed.

22. The combination of more than one molded table as in claim 19 wherein said leg means are shaped, sized and curved to coact with the container means so that a plurality of such molded tables can be stacked one upon the other for shipping, storing and moving.

23. In the combination as in claim 22 including, spacer means on the container means to prevent the any of said plurality of tables from sticking on disassembly when more than one table are stacked and nested together.

* * * * *